United States Patent [19]

Agers et al.

[11] Patent Number: 4,926,661

[45] Date of Patent: May 22, 1990

[54] YARN FINISH APPLICATOR

[75] Inventors: Brian M. Agers, Wilmington, Del.; John S. Dickins, III, Wilmington, N.C.

[73] Assignee: E. I. du Pont de Nemours and Company, Wilmington, Del.

[21] Appl. No.: 323,818

[22] Filed: Mar. 15, 1989

[51] Int. Cl.[5] ..... D06B 1/08

[52] U.S. Cl. ..... 68/200; 118/420

[58] Field of Search ..... 68/200; 118/123, 410, 118/411, 412, 420

[56] References Cited

U.S. PATENT DOCUMENTS

| | | | |
|---|---|---|---|
| 1,651,229 | 11/1927 | Schubert | 118/420 |
| 2,976,177 | 3/1[illegible] | Warthen | 118/420 X |
| 3,393,661 | 7/1968 | Sharp | 118/411 |
| 3,493,422 | 2/1970 | Berry, Jr. | 118/123 X |
| 3,780,699 | 12/1973 | Kime | 118/420 |

*Primary Examiner*—Philip R. Coe

[57] ABSTRACT

A slotted yarn finish applicator in which yarn contacts the bottom of a slot provided with a passage through which finish is metered. The bottom surface of the slot is modified to include uniformly distributed depressions to improve performance.

6 Claims, 3 Drawing Sheets

YARN FINISH APPLICATOR

BACKGROUND OF THE INVENTION

This invention relates to a yarn guiding surface and, more particularly, it relates to a yarn guiding surface of a finish applicator and the method of making such surface.

U.S. Pat. No. 4,397,164 discloses a yarn finish applicator for applying liquid finish to a moving continuous filament yarn. The yarn finish applicator includes a body member that has top, opposed side, front and back surfaces. A slot with bottom and side walls is formed in the front surface running from top to bottom of the body member. The slot has bottom and side walls with a passage connecting with the back surface of the body member through which is metered the desired quantity of liquid finish. The lower portion of the front and back surfaces of the body member are angled downwardly toward each other and in conjunction with the opposed side surfaces which taper downwardly toward each other form an edge at the bottom wall of the slot. The side walls of the slot taper inwardly toward the bottom wall while tapering toward each other at the entrance of the slot. This unique slot configuration not only facilitates placing the moving yarn line in the applicator slot but also prevents the finish from migrating by surface-tension-induced spreading away from the yarn path.

When yarns incorporate additives such as titanium dioxide to produce dull yarn, the yarn becomes abrasive, and when it is passed through such applicators an abrasive action between the yarn and the yarn contacting surface of the applicator occurs, due to the relative movement between the two, which polishes the contacted surface. As a consequence, the friction between the yarn and the contacted surface increases, creating undesirable tension increases in the yarn and a need to frequently replace the applicators.

SUMMARY OF THE INVENTION

In accordance with the invention, to overcome the above-noted problems there is provided a slotted yarn applicator in which yarn contacts the bottom of a slot provided with a passage through which the desired amount of finish is metered. The bottom surface of the slot is modified to include depressions evenly distributed over about 25 to about 50% of the surface of the bottom wall, the remainder of the surface being a yarn contacting surface.

DETAILED DESCRIPTION OF THE PREFERRED EMBODIMENT

Figure 1:
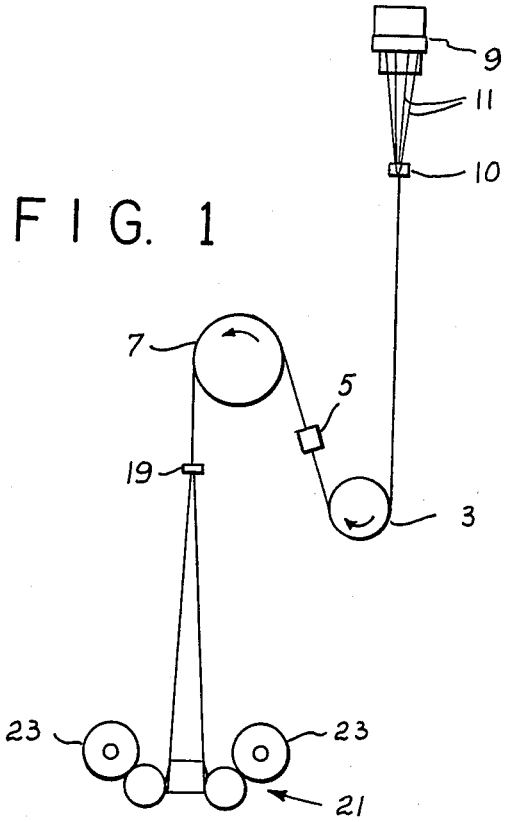
FIG. 1 is a schematic of a process in which this invention is useful.
Figure 2:
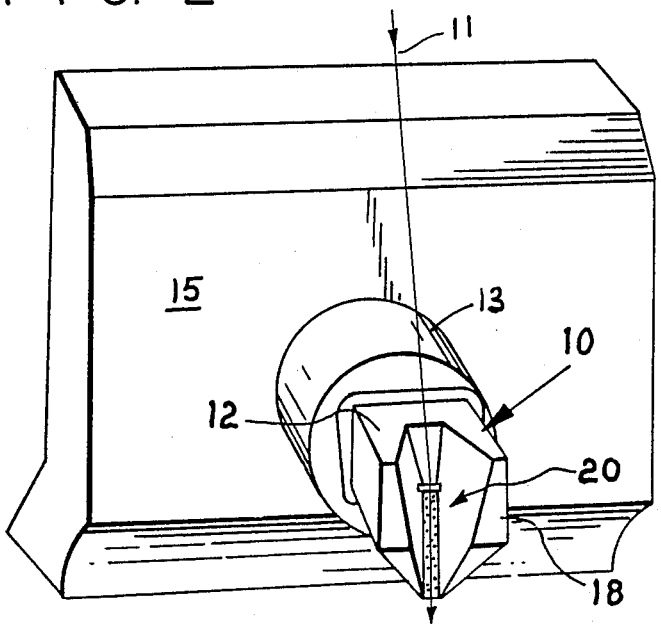
FIG. 2 is an isometric view partially broken away showing a finish applicator which incorporates this invention.
Figure 3:
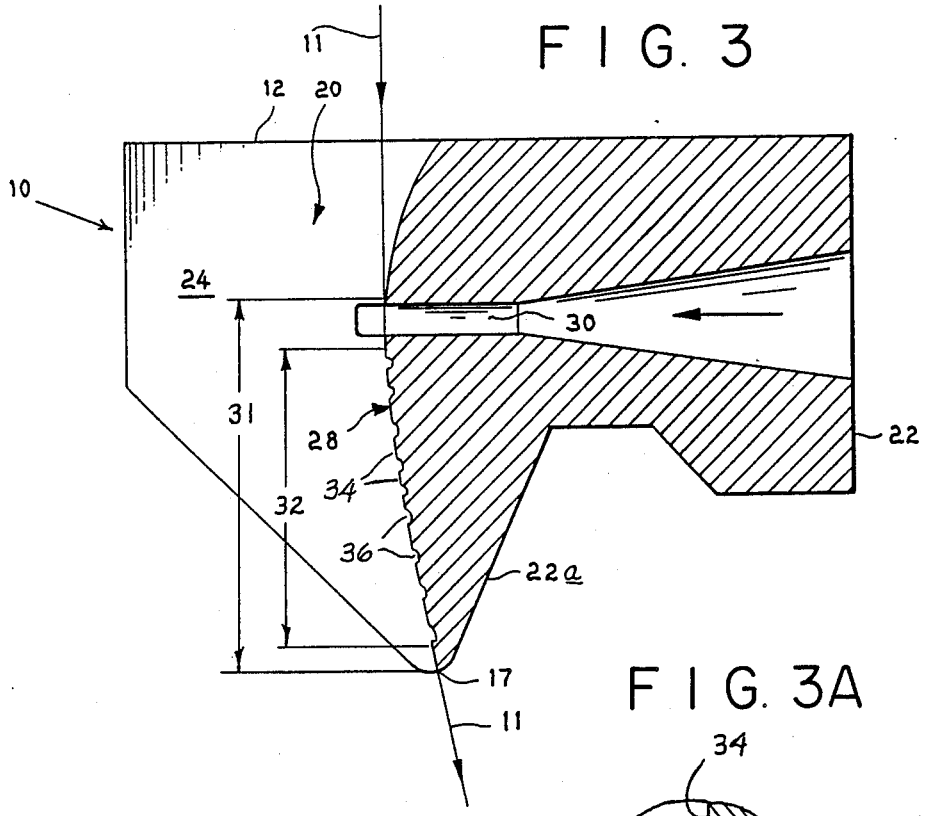
FIG. 3 is an elevation view partially in section of the applicator of FIG. 2
Figure 3A:
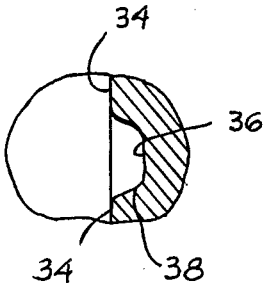
FIG. 3A is an enlargement of a portion of FIG. 2.

As shown in FIG. 1, molten polymer is extruded through a spinning pack 9 to form filaments 11 which are passed through a slotted finish applicator 10 where finish is applied to the discrete filaments. The filaments are then passed around a feed wheel 3, through an interlace jet 5, around a let down roll 7, through fanning guide 19, to a windup 21 where they are wound into packages 23.

Referring to FIGS. 2–5, the embodiment chosen for purposes of illustration includes an applicator body member 10, a pipe 13, and a bracket 15. The pipe 13 is held in a bore through the upper portion of bracket 15 by means of a set screw (not shown). The pipe is connected to a source of liquid finish (not shown). The applicator body member 10 which is cemented into the outlet end of pipe 13 has a top surface 12, opposed side surfaces 14, 16 and a front surface 18 in which is formed a slot 20 and back surface 22 which terminates in a lower portion 22*a*. The slot 20 runs from the top surface 12 to the bottom of the applicator body member and is defined by side walls 24, 26 and bottom wall 28. A passage 30 connects the back surface 22 of the body member with the bottom wall 28 of the slot for supplying a liquid finish to the slot. The yarn 11 runs from top to bottom of the applicator as indicated by the arrow. The yarn filaments spread evenly across the slot and contact a portion 31 of the bottom wall 28 extending from just before or right at passage 30 to an exit edge 17. The body member 10 features a sharp wedge exit edge 17 formed by the bottom area of the slot and surfaces 28, 22*a*, respectively, being angled toward each other and defined on the sides by tapering side surfaces 14, 16.

Figure 4:
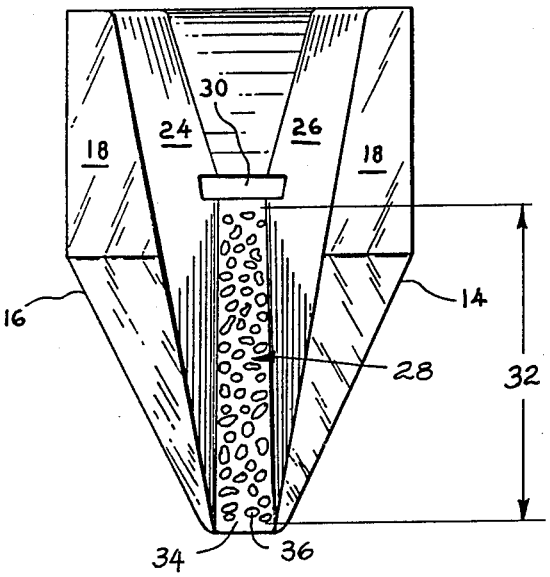
FIG. 4 is a plan view of the applicator of FIG. 2.

As best seen in FIG. 4, the slot 20 is defined by side walls 24, 26 and a bottom wall 28. The side walls 24, 26 taper inwardly toward each other as they approach bottom wall 28 and also taper toward each other as they progress from the top of the applicator body member toward passage 30.

The applicator body 10 is made of a molded ceramic that may be, for instance, chromium dioxide with some titanium dioxide or may be aluminum oxide.

In the applicator of the invention, the bottom surface 28 is modified to form a contoured surface portion 32 that extends from a location near passage 30 to a location near the exit edge 17 of the slot 20. The contoured surface portion 32 of the bottom wall 28 comprises a continuous plateau area 34 which is the yarn contacting surface area and a series of depressed areas 36 spaced from the plateau area by 1–2 mils, i.e. 1–2 mils deep. The surface area 34 is very smooth with a surface roughness in the range of from about 29 to about 32 rms. This plateau/depression surface is distinctly different from most roughened surfaces which have a broad range of peak to valley distances that average to a particular value. In a preferred surface of the invention, all of the depressions are at a controlled depth (valley) with respect to the plateau surface (peak), the depth being essentially the same for all depressions. An alternate embodiment, however, may be achieved by selective, multiple pass, photomasking and etching when forming the mold surface so that different groups of depressions may be formed at different depths that may be advantageous for some applications, as when one applicator is used with different yarns and finishes. With a selected group, the depression depths would be essentially the same.

The planar area of the plateau 34 and the planar area of the depressions 36 are essentially parallel to one another and a depression area 36 is joined to the plateau area 34 by a short transition surface 38 defining the circumference of the depression, the transition surface being at a steep angle to the areas. The plateau area 34 supports the yarn as it is pulled across the surface. The depressed areas 36, distributed evenly or uniformly across the surface, hold small pools of finish fluid which provide a source of lubricant between the yarn and the plateau area. It is believed that the contoured surface portion 32 of the ceramic part acts to provide a controlled contact, well lubricated surface area to the yarn; this area is considerably less than the surface area without any contour. This lubricated, reduced contact area reduces the drag on the yarn so the yarn can be pulled across the finish applicator with very low tension. Lower tension reduces filament damage and provides greater flexibility in downstream yarn processing. The low drag also results in very low wear on the bottom wall of the applicator which is particularly noticeable with highly abrasive yarns. This reduces the maintenance and parts costs for applying finish to the yarn.

Figure 5:
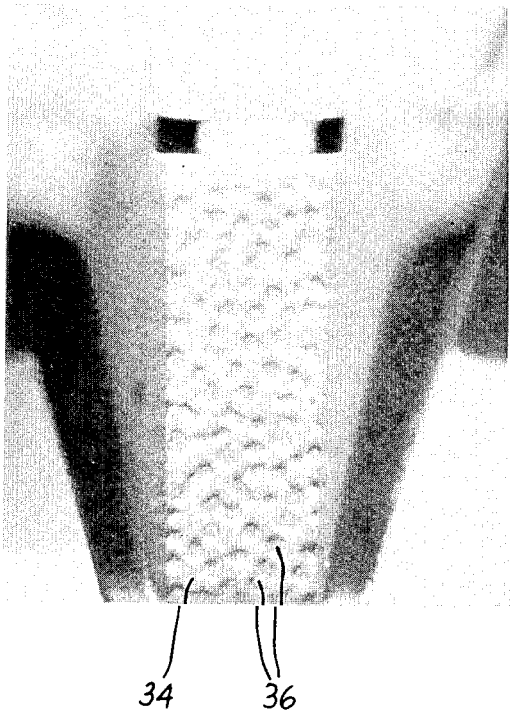
FIG. 5 is a photograph, enlarged 13X, of the slotted finish applicator as illustrated in FIG. 4.

The sum of the plateau area 34 and the depression area 36 is approximately equal to the total projected area of the contoured surface 32. To achieve the desired decreased yarn contact area of the plateau and the fluid reservoir area of the depressions, the sum of the depression areas 36 is preferably about 25–50% of the area 32. FIG. 5 represents a contoured surface with an average depressed area of about 38%. The depressions 36 have various shapes and sizes. In general, the shapes are circular, but in numerous instances one, two, three or four circular shapes run together to form "dog-bone" shapes. Looking at 63 different depressions, the average area of a depression is about 51,600 square micrometers +/− 34,700 micrometers, the total range being from 153,900 to 6000 square micrometers.

The contoured surface is made by known photomasking and etching processes applied to a metal mold to produce a non-repeating pattern, or texture, of shallow depressions in a molded ceramic part. This is in contrast to an "etched" surface known to be useful in finish applicators where the metal part is not photomasked but is flooded with an acid for a time to roughen a smooth finished part. Such a process produces a random surface of pits and peaks when there is a differential effect of the acid on the surface composition of the metal. Such a surface usually has a roughness less than 32 rms.

EXAMPLE I.

Trilobal cross-section polyester partially oriented yarns of 255 denier/50 filaments and containing 1.5% $TiO_2$ were spun at 3580 ypm (3274 mpm) using a process as represented in FIG. 1. A finish solution containing 6.5% solids was applied to these yarns with either the contoured surface finish applicators of this invention or with finish applicators in which the bottom surface was not modified. Yarn tensions were measured after the finish was applied and before the yarn contacted the feedwheel. These measurements were made shortly after the installation of new finish tips, and at intervals thereafter, as seen below:

| Days of Use/Tips | Contoured Tips | Unmodified Tips |
|---|---|---|
| 0 | 30.0 gms | 40.7 gms |

-continued

| Days of Use/Tips | Contoured Tips | Unmodified Tips |
|---|---|---|
| 4 | 31.4 gms | 45.4 gms |
| 8 | 32.2 gms | 47.4 gms |
| 12 | 33.5 gms | 48.8 gms |

EXAMPLE II

Trilobal polyester flat yarns of the type described in U.S. Pat. No. 4,156,071 were spun at 4550 ypm (4160 mpm) using a process as represented by FIG. 1. These yarns were of 75 denier/34 filaments and they contained 0.035% $TiO_2$. A finish containing 12% solids was applied with new finish tips and yarn tensions (in grams) were measured at the following locations in the process:

| Location | Contoured Tips | Unmodified Tips |
|---|---|---|
| Pre Feedwheel | 26.3 | 33.9 |
| Pre Jet | 15.9 | 20.7 |
| Pre Wind-up | 14.3 | 16.7 |

The tensions with the contoured tips were lower even though adjustments were made in yarn overfeed to compensate for the lower tension that was obtained with the contoured finish tips; the surface speed at the wind-up was 91 ypm less than that measured at the feedwheel when unmodified tips were used whereas the speed differential (overfeed) with the contoured tips was only 44 ypm.

What is claimed is:

1. A slotted yarn finish applicator in which yarn contacts the bottom surface of a slot while passing through the slot, said slot having an entrance and an exit end, there being relative movement between the yarn and the bottom surface, said slot being provided with a passage through which finish is metered to said bottom surface, a portion of said bottom surface that extends from a location near said passage to a location near said exit having a plurality of depressions evenly distributed over from about 25 percent to about 50 percent of said portion, said depressions forming discontinuous interruptions in said portion of said bottom surface in all directions, the remainder of said portion forming a yarn contacting surface.

2. The applicator as defined in claim 1, said depressions being from about 1 mil to about 2 mil deep.

3. A stationary yarn finish applicator surface in which yarn contacts said surface, said surface being provided with a passage through which finish is metered to said surface, said surface having a plurality of depressions evenly distributed over from about 25 percent to about 50 percent of said surface, said depressions forming discontinuous interruptions in said surface in all directions.

4. The yarn finish applicator of claim 3, said depressions being from about 1 mil to about 2 mil deep.

5. The slotted yarn finish applicator of claims 1, 2, 3, or 4 wherein each depression has a bottom planar surface, said bottom planar surface being substantially parallel to said yarn contacting surface.

6. The slotted yarn finish applicator of claim 5 wherein said depressions are substantially the same depth.

* * * * *